US006092304A

United States Patent [19]

Karlsson et al.

[11] Patent Number: 6,092,304

[45] Date of Patent: Jul. 25, 2000

[54] BLOW BOX FOR USE IN A PLANT FOR DRYING A MATERIAL WEB

[75] Inventors: Ingemar Karlsson; Roger Sigvant, both of Växjö ; Claes Halldin, Gemla; Lars Nilsson, Växjö, all of Sweden

[73] Assignee: ABB Fläkt AB, Stockholm, Sweden

[21] Appl. No.: 09/066,464

[22] PCT Filed: Oct. 9, 1996

[86] PCT No.: PCT/SE96/01277

§ 371 Date: Jun. 18, 1998

§ 102(e) Date: Jun. 18, 1998

[87] PCT Pub. No.: WO97/16594

PCT Pub. Date: May 9, 1997

[30] Foreign Application Priority Data

Oct. 31, 1995 [SE] Sweden ..... 9503822

[51] Int. Cl.[7] ..... F26B 9/00

[52] U.S. Cl. ..... 34/640; 34/629

[58] Field of Search ..... 34/629, 632, 633, 34/640

[56] References Cited

U.S. PATENT DOCUMENTS 3,982,327 9/1976 Kurie et al. .
4,719,708 1/1988 Karlsson et al. .
5,471,766 12/1995 Heikkila et al. ..... 34/461
5,946,819 9/1999 Reimer et al. ..... 34/451

FOREIGN PATENT DOCUMENTS

0561256 A1 9/1993 European Pat. Off. .

OTHER PUBLICATIONS

Berndt Kaltin, "More Capacity in Less Space with Fläkt New Compact Pulp Dryer", Sweden.
Jorgen G. Hedenhag, "New Applications for Flakt Paper Dryers", Connecticut, Jan. 1976.

*Primary Examiner*—Henry Bennett
*Assistant Examiner*—Malik N. Drake
*Attorney, Agent, or Firm*—Birch, Stewart, Kolasch & Birch, LLP

[57] ABSTRACT

A blowbox for use in a plant for drying a material web includes an essentially horizontal box wall having formed therein circular orifices and eyelid perforations each of which includes a slit extending in parallel with the center line of the upper box wall. A depression is formed m the upper box wall adjacent one side of the slit. The eyelid perforations are arranged in two rows and parallel with the center line and together they form a zigzag pattern about the center line that intersects the depressions of the eyelid perforations in both rows. The orifices are disposed in a first and second pair of rows with both rows in each pair positioned on either side of and spaced equally from the center line. The upper box wall has a shallow continuous arcuate shape across its entire width.

5 Claims, 4 Drawing Sheets

BLOW BOX FOR USE IN A PLANT FOR DRYING A MATERIAL WEB

This application claims the benefit under 35 U.S.C. §371 of prior PCT International Application No. PCT/SE96/01277, which has an International filing date of Oct. 9, 1996, which designated the United States of America, the entire contents of which are hereby incorporated by references.

FIELD OF THE INVENTION

The subject invention relates to a blow box intended to be used in a plant for drying a material web, such as a web of papermaking pulp being advanced through said plant, said blow box having an elongate, essentially right-angled parallelepipedon shape including an essentially horizontal upper box wall and being intended to be placed, jointly with a plurality of identical blow boxes, below the material web for the purpose of holding the material web floating, i.e. suspended in the air in a well-defined stable position above the upper blow box wall by means of air streams that are being blown out of the box while simultaneously drying the material web, said blow box being designed to be placed below the material web in a manner ensuring that the longitudinal centre line of the upper box wall extends transversely of the direction of advancement of the web, the upper wall of said blow box being formed with a plurality of essentially circular nozzle orifices, and with a plurality of so-called eyelid perforations, each one of said perforations consisting of a slit extending in parallel with said centre line and of a depression formed in the upper box wall adjacent the slit, at one side of the latter, said eyelid perforations being arranged in two rows extending in parallel with and on either side of the centre line, said nozzle orifices being arranged in rows, likewise extending in parallel with and on either side of said centre line, the eyelid perforations in one row being so displaced in the longitudinal direction of the blow box relatively to the eyelid perforations of the other row that the eyelid perforations of both rows together form a zigzag pattern, the eyelid perforations of both rows being directed in such a manner as to cause air to exit essentially in parallel with the upper box wall, towards said centre line, and essentially perpendicularly thereto, and the nozzle orifices being directed in such a manner as to cause air to exit essentially at right angles to the upper box wall.

SUMMARY AND OBJECTS OF THE INVENTION

The purpose of the subject invention is to provide a blow box of the kind outlined in the aforegoing and designed to provide improved heat transfer and thus improved drying efficiency compared with prior-art blow boxes of this kind, and also provide an increased floating height or higher level of suspension of the material web in the air, this being achieved under equal air efficiency and web fixation conditions.

This purpose is achieved in accordance with the invention with the aid of a blow box of the kind defined in the introduction and characterised in that the slits of the eyelid perforations in both rows are equally spaced from said centre line, that said centre line intersects the depressions of the eyelid perforations in both rows, that the nozzle orifices are arranged in respectively a first and a second pair of rows, the two rows of each pair being positioned on either side of and spaced equally from said centre line, that the distance of the rows of the first pair to said centre line is smaller than the distance of the rows of the second pair to said line, that for each eyelid perforation there is a corresponding nozzle orifice in the row of the first pair of nozzle orifices that is positioned on the same side of said centre line as a slit of the associated eyelid perforation, and also a corresponding nozzle orifice in the row of the second pair that is positioned on the opposite side of said centre line, each eyelid perforation and its two corresponding nozzle orifices being essentially in alignment in the crosswise direction of the blow box, and in that the upper box wall has a shallow continuous arcuate shape across its entire width.

In accordance with a preferred embodiment the height of the arc H representing the arcuate shape of the upper box wall is related to the degree of perforation P as follows: $H=k\cdot P-5.88$, wherein k is a constant which is between 6.2 and 6.9 when H is denoted in mm and P in %.

The product of the distance $l_2$, in mm, between the centre line and the edge of the alit closest to said line, and the width L of the blow box, in mm, advantageously is 2,800–4,100, preferably approximately 3,440.

The ratio of the length $l_1$ of the depression to the distance $l_2$ between said centre line and the edge of the slit closest to that line advantageously is 1.2–1.6, preferably 1.4.

BRIEF DESCRIPTION OF THE INVENTION

The invention will be described in closer detail in the following with reference to the accompanying drawings, wherein.

DETAILED DESCRIPTION OF THE INVENTION

Figure 1:
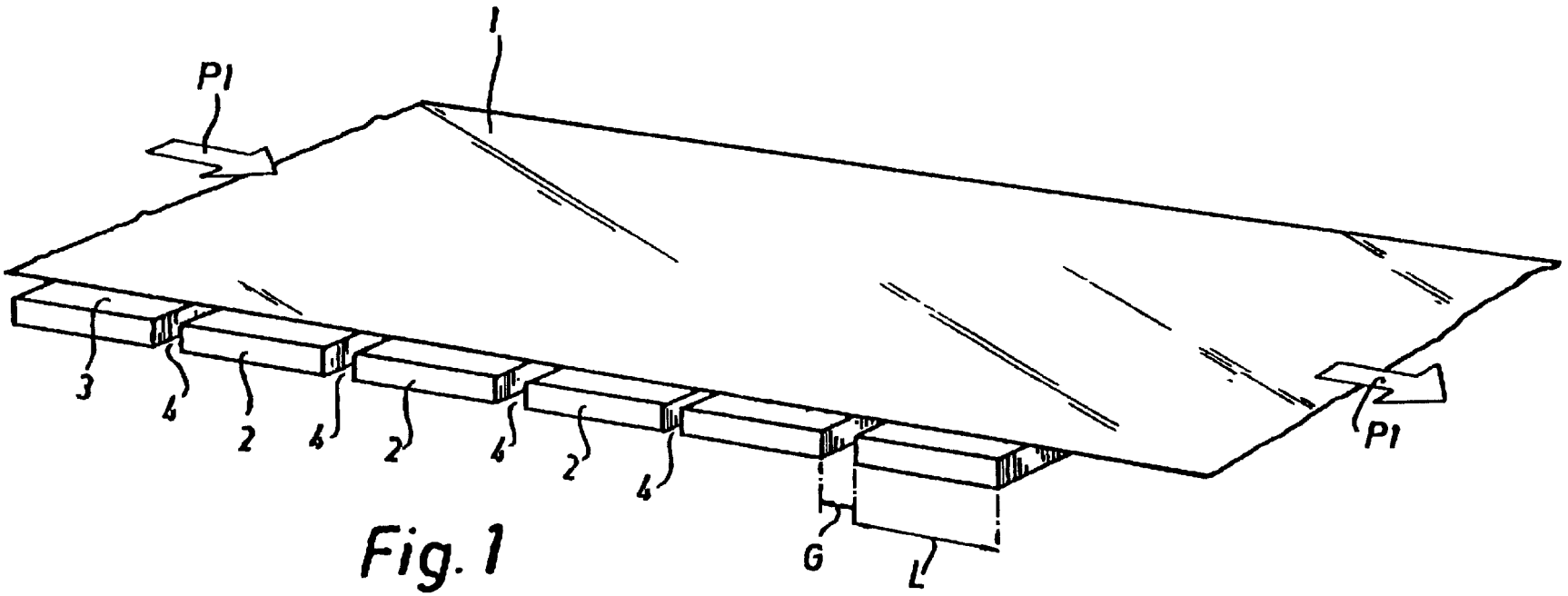
FIG. 1 is a perspective view, schematically illustrating a plant for drying a material web with the aid of blow boxes in accordance with the invention.

FIG. 1 illustrates a material web 1, for example a web of papermaking pulp, which is being advanced through a plant for drying the web. The material web 1 is advanced horizontally through the plant, and its direction of travel is illustrated in FIG. 1 by means of arrows P1.

A plurality of identical blow boxes 2, each one being shaped as an elongate, right-angle parallelepiped including an essentially horizontal upper box wall 3, are positioned underneath the material web 1 with the upper surfaces of the box walls 3 positioned in the same horizontal plane. The blow boxes 2 have an extension at right angles to the direction of travel PI of the material web 1 and are arranged side by side, separated by a predetermined gap 4.

The upper wall 3 of each blow box 2 is formed with a plurality of air-exit apertures 5 and 6 to be described in closer detail further on. Fan means (not shown) force air into the blow boxes 2. The air exits from the blow boxes 2 by way of the apertures 5 and 6. The exiting air carries the material web 1, thus sustaining the latter floating or suspended in the air at a predetermined floating height or level of suspension above the blow boxes 2. The exiting air also transfers heat to the material web 1 for the purpose of drying the latter. The air blown out of the blow boxes 2 is caused to exit by way of the gaps 4 intermediate the blow boxes 2.

Figure 5:
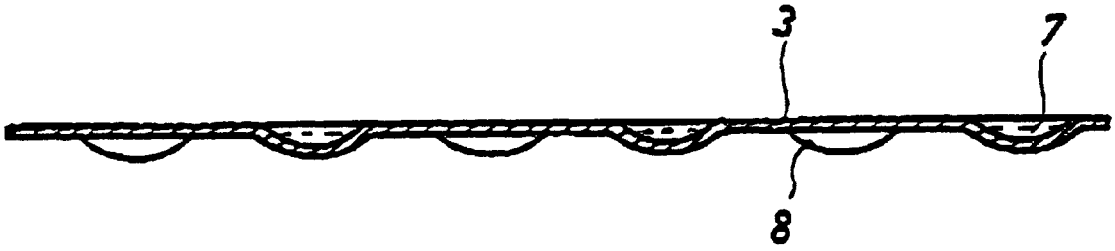
FIG. 5 is a sectional view along line V—V In FIG. 2 of a part of the blow box.
Figure 6:
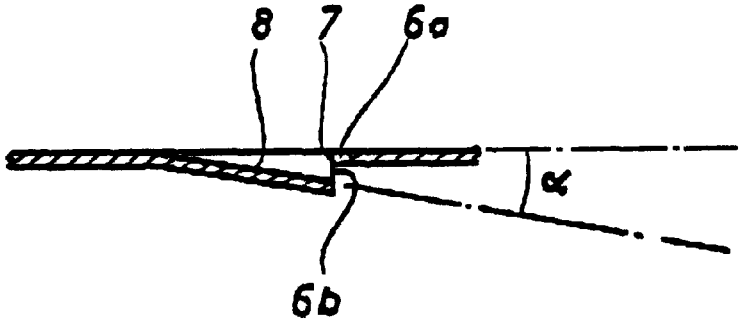
FIG. 6 illustrates an eyelid perforation in a sectional view along line VI—VI in FIG. 2.

The air-exit apertures S and 6 consist of a plurality of circular nozzle orifices 5 and a plurality of so-called eyelid perforations 6. Each eyelid perforation 6 consists of a slit 7 extending in parallel with the lengthwise centre line C of the upper box wall 3, and of a depression 8 formed adjacent the slit 7 at one side of the latter. The depression 8 is produced from the upper face of the upper box wall 3. The depression 8 has an essentially parabola-shaped peripheral outline and a depth that decreases in a direction perpendicularly away from the slit 7 (see FIG. 6). The cross-sectional configuration of the depression 8 as seen in parallel with the slit 7 is arcuate (see FIG. 5). Thus, the air-exit aperture 6 proper consists of one upwardly open part 6*a* delimited by the slit 7 and causing the exiting air to flow essentially perpendicularly to the upper box wall 3, and one part 6*b* (FIG. 6) which is open in the transverse direction of the blow box 2 and which is defined between the upper box wall 3 and the edge of the depression 8 that is closest to the slit 7, said part 6*b* serving to cause the exiting air to flow in a direction essentially in parallel with the upper box wall 3.

The eyelid perforations 6 are arranged in two rows extending in parallel with and positioned on either side of the centre line C. The slits 7 of the eyelid perforations 6 in the two rows are equally spaced from the centre line 6. The eyelid perforations 6 in one row are displaced in the lengthwise direction of the blow box 2 in relation to the eyelid perforations 6 of the other row in such a manner that together the eyelid perforations of the two rows form a zigzag-shaped pattern.

Figure 2:
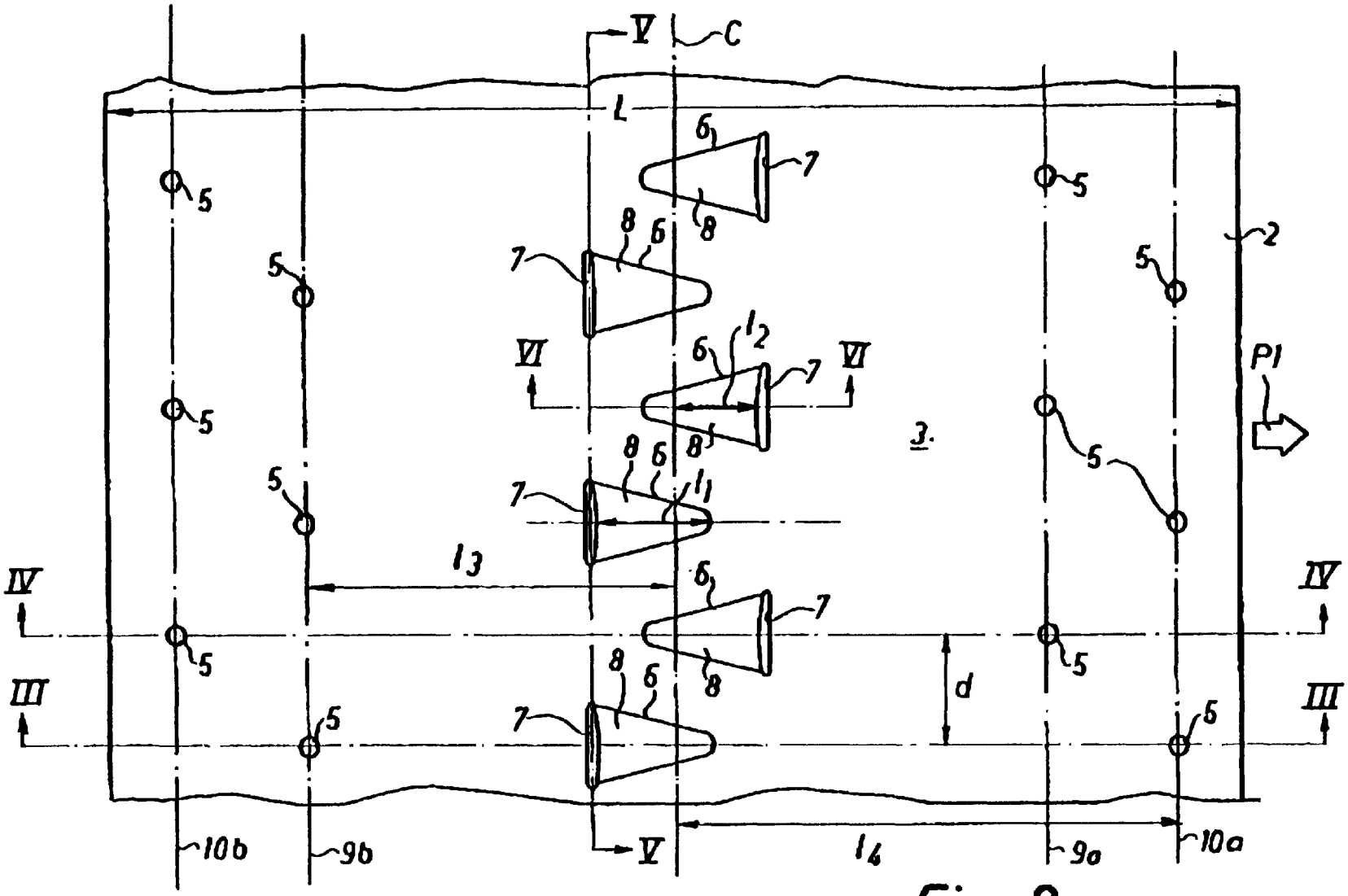
FIG. 2 is a view showing a part of a blow box in accordance with the invention.

The orientation of the eyelid perforations 6 in both rows is such that the exiting air caused to flow essentially in parallel with the upper box wall 3 is directed towards the centre line C, essentially at right angles thereto. The spacing between the slits 7 and the centre line C is such that the centre line C intersects the depressions 8 (see FIG. 2).

The circular nozzle orifices 5 forcing the air to exit essentially at right angles to the upper box wall 3 are arranged in a first and a second pair of rows 9*a*, 9*b* and 10*a*, 10*b*, respectively, extending in parallel with the centre line C. The two rows 9*a*, 9*b* and 10*a*, 10*b*, respectively, of each pair are positioned on either side of and spaced equally from the centre line C. The spacing of rows 9*a*, 9*b* of the first pair from the centre line C is shorter than the spacing of the rows 10*a*, 10*b* of the second pair from that line.

For each eyelid perforation 6 two corresponding nozzle orifices 5 are provided, viz. one nozzle orifice 5 in the row 9*a* or 9*b* of the first pair that is positioned on the some side of the centre line C as the alit 7 of the associated eyelid perforation 6 and one nozzle orifice in the row 10*a* or 10*b* of the other pair that is positioned on the opposite side of the centre line C. Each eyelid perforation 6 and its two corresponding nozzle orifices 5 are positioned in mutual alignment relationship or at least in essential mutual alignment relationship in the transverse direction of the blow box 2.

Figure 3:
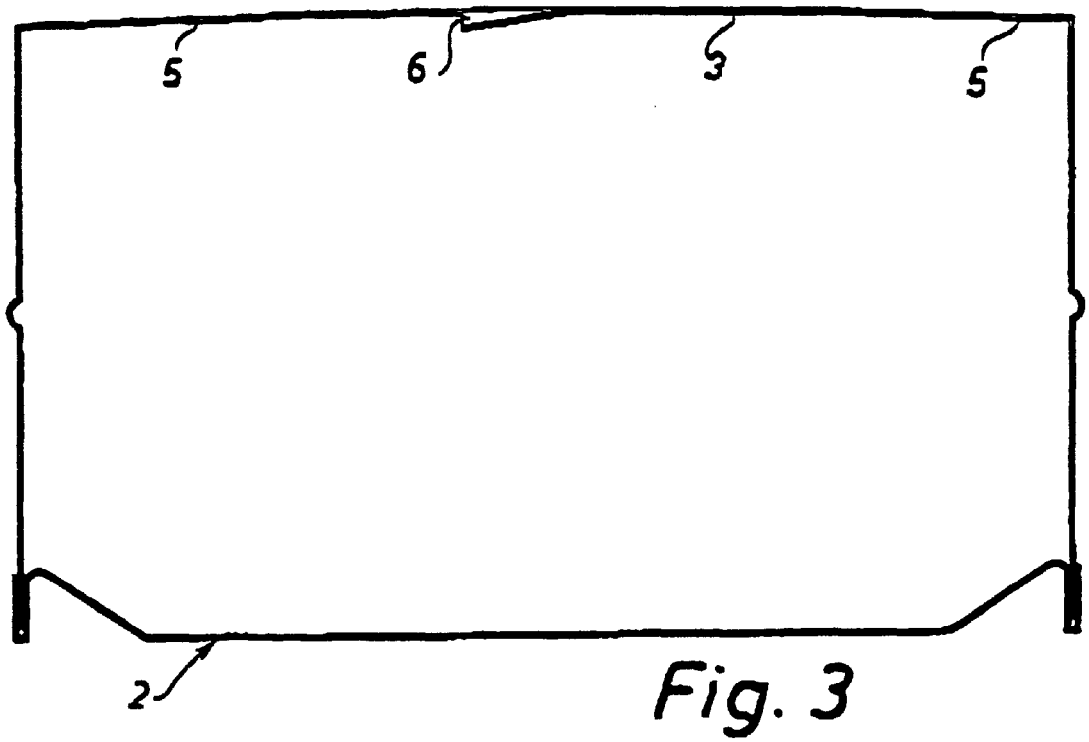
FIG. 3 illustrates the blow box in a sectional view along line III—III in FIG. 2.
Figure 4:
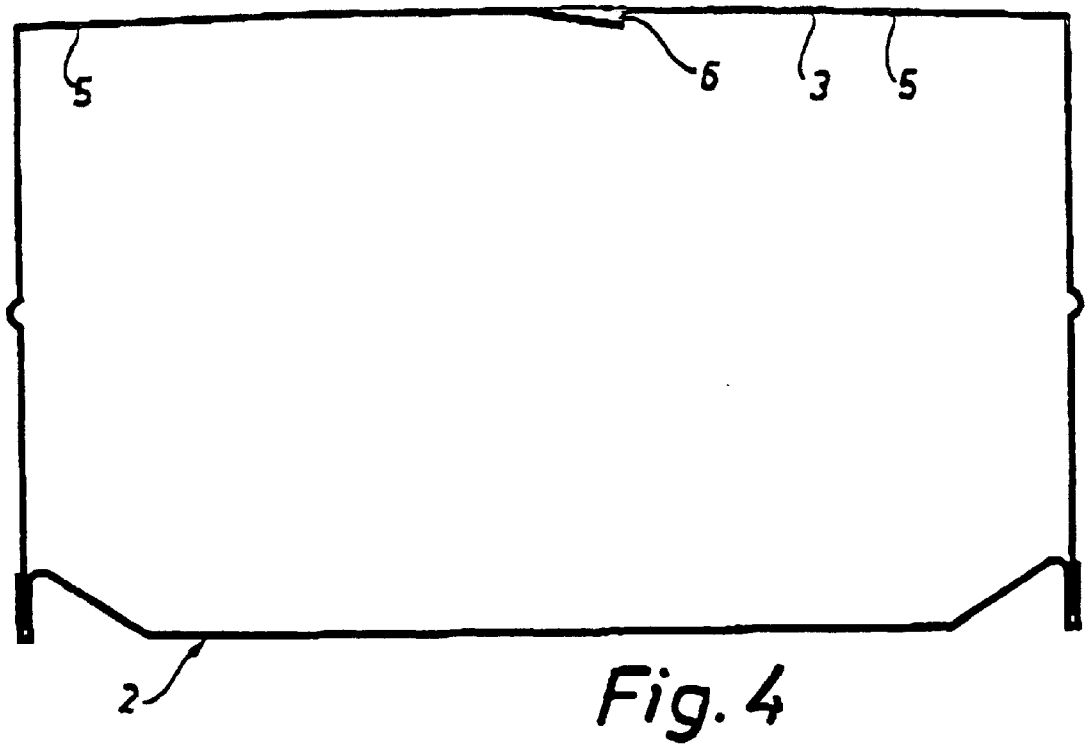
FIG. 4 illustrates the blow box in a sectional view along line IV—IV of FIG. 2.

The upper box wall 3 has a shallow continuous arcuate shape (see FIGS. 3 and 4) across its entire width, viz. also in the area occupied by the eyelid perforations 6. The arcuate shape in this area is achieved in that the punching and stamping tools used to produce the eyelid perforations 6 have a shape corresponding to the arc curvature.

The box 2 in accordance with the illustrated preferred embodiment, which has been tested and found to function in a highly satisfactory manner, has a width L of 215 mm, and the length and width of the slits 7 are 15 mm and 1.5 mm respectively, the length $l_1$ of the depressions 8 perpendicularly to the centre line C is 22.5 mm, the angle of depression $\alpha$ of the depressions 8 (see FIG. 6) is approximately 10°, the distance $l_2$ from the centre line C to the slit edge positioned closest thereto is 16 mm, the mutual spacing d between the eyelid perforations 6 in both rows is 20 mm, the diameter of the nozzle orifices 5 is 3.7 mm, the distances $l_3$ and $l_4$ between the centre line C and respectively the rows 9*a*, 9*b* and 10*a*, 10*b* in the first and second pairs of orifice rows are 70 mm and 95 mm, respectively, and the radius of curvature of the arcuate shape of the upper box wall 3 is 1,927 mm with a consequential height of the arc H of 3.0 mm.

As shown, the product of $l_2 \cdot L$ is 16·215=3,440, when the values are expressed in mm. This product is of essential importance to web fixation and preferably lies in the interval 2,800 to 4,100. As further evidenced, the ratio $l_1/l_2$=22.5/16=1.4. This ratio is essential to the floating height or level of air suspension of the web and preferably falls within the interval 1.2 to 1.6.

In addition, in accordance with the embodiment illustrated each nozzle orifice 5 has an area $A_1$ of 10.8 $mm^2$ and the upwards open part 6*a* (slit 7) and the part 6*b* open in the cross-sectional direction of the box 2 of each eyelid perforation 6 have areas $A_2$ and $A_3$ of respectively 22.5 $mm^2$ and 23.6 $mm^2$. As shown, $2A_1 \approx A_2 \approx A_3$, providing satisfactory heat transfer and a sufficient floating height or level of air suspension of the web.

By "degree of perforation" P should in this case be understood the ratio between areas $2A_1+A_2+A_3$ and (L+G)·d, wherein G designates the width of the gap 4 which in accordance with the embodiment illustrated preferably is 35 mm. Thus, in accordance with the embodiment illustrated the degree of perforation $$P=(2\cdot 10.8+22.5+23.6)/(215+35)\cdot 20\approx 0.0135,$$

i.e. 1.35%. Tests have been performed using different blow boxes wherein the spacing d varied between 20 mm and 28 mm. It was found that highly satisfactory operational conditions were obtained at the occurrence of a specific ratio between the height of the arc H and the degree of perforation P. The relation may be expressed as H=k·P−5.88, wherein k is a constant of between 6.2 and 6.9 when H is denoted in mm and P in %.

We claim:

1. A blow box intended to be used in a plant for drying a material web (1), such as a web of papermaking pulp being advanced through said plant, said blow box having an elongate, essentially right-angled parallel-epipedon shape including an essentially horizontal upper box wall (3) and being intended to be placed, jointly with a plurality of identical blow boxes, below the material web (1) for the purpose of holding the material web floating, i.e. suspended in the air, in a well-defined position above the upper blow box wall (3) by means of air streams that are being blown out of the box while simultaneously drying the material web, said blow box being designed to be placed below the material web (1) in a manner ensuring that the longitudinal centre line (C) of the upper box wall (3) extends transversely of the direction of advancement (P1) of the web (1), the upper well (3) of said blow box being formed with a plurality of essentially circular nozzle orifices (5), and with a plurality of so-called eyelid perforations (6), each one of said perforations consisting of a slit (7) extending in parallel with said centre line (C) and of a depression (8) formed in the upper box wall (3) adjacent the slit, at one side of the latter, said eyelid perforations (6) being arranged in two rows extending in parallel with and on either side of the centre line (C), said nozzle orifices being arranged in rows (9*a*, 9*b*, 10*a*, 10*b*), likewise extending in parallel with and on either side of said centre line (C), the eyelid perforations in one row being so displaced in the longitudinal direction of the blow box relatively to the eyelid perforations of the other row that the eyelid perforations of both rows together form a zigzag pattern, the eyelid perforations (6) of both rows being oriented in such a manner as to cause air to exit essentially in parallel with the upper box wall (3), towards said centre line (C), and essentially perpendicularly thereto, and the nozzle orifices (5) being directed in such a manner as to cause air to exit essentially at right angles to the upper box wall (3), characterised in that the slits (7) of the eyelid perforations (6) in both rows are equally spaced from said centre line (C), that said centre line (C) intersects the depressions (8) of the eyelid perforations (6) in both rows, that the nozzle orifices (5) are arranged in respectively a first and a second pair of rows (9*a*, 9*b* and 10*a*, 10*b*, respectively), the two rows of each pair being positioned on either side of and spaced equally from said centre line (C), that the distance of the rows (9*a*, 9*b*) of the first pair to said centre line (C) is smaller than the distance of the rows (10*a*, 10*b*) of the second pair to said line, that for each eyelid perforation (6) there is a corresponding nozzle orifice (5) in the row (9*a* or 9*b*) of the first pair of nozzle orifices that is positioned on the same side of said centre line (C) as a slit (7) of the associated eyelid perforation (6), and also a corresponding nozzle orifice (5) in the row (10*a*, 10*b*) of the second pair that is positioned on the opposite side of said centre line (C), each eyelid perforation (6) and its two corresponding nozzle orifices (5) being essentially in alignment in the crosswise direction of the blow box, and in that the upper box wall (3) has a shallow continuous arcuate shape across its entire width.

2. A blow box as claimed in claim 1, characterised in that the height of the arc H of the arcuate shape of the upper box wall (3) is related to the degree of perforation P as follows: $H=k\cdot P-5.88$, wherein k is a constant which is between 6.2 and 6.9 when H is denoted in mm and P in %.

3. A blow box as claimed in claim 1 or 2, characterised in that the product of the distance $l_2$, in mm, between said centre line (C) and the edge of the slit (7) closest to said line, and the width L of said blow box (2), in mm, is 2,800–4,100, preferably about 3,440.

4. A blow box as claimed in claim 1 or 2, characterised in that the ratio of the length $l_1$ of the depression (8) to the distance $l_2$ between said centre line (C) and the edge of the slit positioned closest to that line is 1.2–1.6, preferably 1.4.

5. A blow box intended to be used in a plant for drying a material web, said web processing paper pulp and having an elongate, essentially right-angled parallel-piped shape including an essentially horizontal upper box wall, said wall being disposed jointly with a plurality of identical blow boxes below the material web for the purpose of holding the material web floating in a well-defined position above the upper blow box wall by means of air streams that are being blown out of the box while simultaneously drying the material web, said blow box being disposed below the material web to ensure that the longitudinal centre line of the upper box wall extends transversely of the direction of advancement of the web, the upper wall of said blow box being formed with a plurality of essentially circular nozzle orifices and with a plurality of eyelid perforations consisting of a slit extending in parallel with said centre line and of a depression formed in the upper box wall adjacent the slit, at one side, said eyelid perforations being arranged in two rows extending in parallel with on either side of the centre line, said nozzle orifices being arranged in rows extending in parallel with and on either side of said centre line, the eyelid perforations in one row being so displaced in the longitudinal direction of the blow box relatively to the eyelid perforations of the other row such that the eyelid perforations of both rows together form a zigzag pattern, the eyelid perforations of both rows being oriented in such a manner as to cause air to exit essentially in parallel with the upper box wall towards said centre line and essentially perpendicularly thereto, the nozzle orifices being directed in such a manner as to cause air to exit substantially at right angles to the upper box wall, the slits of the eyelid perforations in both rows being equally spaced from said centre line, said centre line intersecting the depressions of the eyelid perforations in both rows, the nozzle orifices being arranged in respective first and second pair of rows, the two rows of each pair being positioned on either side of and spaced equally from said centre line, the distance of the rows of the first pair to said centre line being smaller than the distance of the rows of the second pair to said line, each eyelid perforation having a corresponding nozzle orifice in the row of the first pair of nozzle orifices, each corresponding nozzle orifice being positioned on the same side of said centre line as a slit of the associated eyelid perforation, a corresponding nozzle orifice in the row of the second pair being positioned on the opposite side of said centre line, each eyelid perforation and its two corresponding nozzle orifices being essentially in alignment in the cross-wise direction of the blow box, the upper box wall having a shallow continuous arcuate shape across its entire width, a ratio of a length of the depression to a distance between the centre line and an edge of a respective slit being positioned closest to that line is generally between 1.2–1.6.

* * * * *